US005782629A

United States Patent [19]

Lannutti

[11] Patent Number: 5,782,629

[45] Date of Patent: Jul. 21, 1998

[54] RADIANT BURNER SURFACES AND METHOD OF MAKING SAME

[75] Inventor: John J. Lannutti, Columbus, Ohio

[73] Assignee: The Ohio State University, Columbus, Ohio

[21] Appl. No.: 589,423

[22] Filed: Jan. 22, 1996

[51] Int. Cl.[6] ..... F23D 3/40

[52] U.S. Cl. ..... 431/326; 431/328; 431/329

[58] Field of Search ..... 431/326, 328, 431/329

[56] References Cited

U.S. PATENT DOCUMENTS

| | | | |
|---|---|---|---|
| 4,878,837 | 11/1989 | Otto | 431/326 X |
| 4,977,111 | 12/1990 | Tong et al. | 501/95 |
| 5,165,887 | 11/1992 | Ahmady | 431/329 X |
| 5,218,952 | 6/1993 | Neufeldt | 431/326 X |

*Primary Examiner*—Larry Jones

*Attorney, Agent, or Firm*—Francis T. Kremblas, Jr.; Kremblas, Foster, Millard & Pollick

[57] ABSTRACT

A porous surface radiant burner assembly provided with a porous burner substrate having a surface including a layer of zircon and an overlying layer of zirconia formed in situ upon exposing the zircon layer to radiant burner operating conditions. The porous surface burner substrate can be in the form of a mat of randomly oriented fibers coated with zircon, a solid parted plate of zircon or a different ceramic provided with a coating layer of zircon, or a reticulated foam comprising either zircon or a different ceramic material coated with zircon. Preferably in the method of making the porous burner substrate, the zircon layer is merely exposed to the intended operating conditions of the radiant burner wherein during the initial degradation of the zircon layer, a continuous, adherent layer of zirconia is formed in overlying relationship to the layer of zircon to resist further degradation.

8 Claims, 1 Drawing Sheet

RADIANT BURNER SURFACES AND METHOD OF MAKING SAME

TECHNICAL FIELD

The present invention relates generally to porous surface radiant burners and particularly to a novel structure and method for making a porous burner surface.

BACKGROUND ART

Radiant burners are often defined as any fuel burning device that releases a substantial fraction of its energy by way of infrared radiation and directs this energy towards a load. The source of the radiation is usually a non-combustible solid surface that is heated by radiation and convection from a combustion reaction. These types of burners maximize the radiation output of the combustion process since the radiating surface is generally made of materials having high emissivities and high temperature capabilities.

Radiant burners are typically classified as indirect-fired or direct-fired. Indirect-fired radiant burners contain the combustion reaction such that combustion products are not released into the area being heated. The most typical design has a conventional flame burner inside a chamber or tubing which becomes the radiant surface. Direct-fired burners include two different types. One is the direct impingement type in which a conventional flame impinges directly onto a refractory surface, causing the surface to radiate heat. The other type is the porous surface burner where combustion is promoted on the surface of the radiant surface flamelessly. That is, no visual flame is apparent, merely an incandescence. A mixture of combustion reactants are fed into the porous substrate forming the burner surface such that combustion occurs on the outer surface of the burner substrate surface, heating said surface to incandescence.

While porous surface burners possess certain advantages over other types, they have not had wide application in the industrial market because industrial applications are more demanding and often involve dirty conditions, both of which adversely affect burner life and reliable performance.

Prior work in this field has shown that certain variations in the materials employed to form the porous radiant burner surface indicate that extended life and good thermal performance suitable for industrial applications can be obtained. However, the better of these designs also involve more expensive burner substrate materials. Prior to the present invention, those skilled in the art have failed to provide a solution which promotes the required long life and thermal performance at a significantly reduced material cost.

BRIEF DISCLOSURE OF INVENTION

The present invention relates generally to radiant burners of the porous surface type and particularly to a novel method of construction and the resulting structure for a porous burner surface for use in radiant burners.

In accordance with the present invention, a novel porous radiant burner surface is disclosed wherein a very inexpensive material, zirconium silicate, (commonly referred to as zircon) is used in the formation of the porous burner surface. The porous burner surface layer incorporating zircon may be fabricated using the conventional techniques known to those skilled in the art. These include forming a solid plate having a plurality of discrete ports, which is referred to as a ported tile construction. Another form is a reticulated foam having the appropriate porous construction. Additionally, the zircon can be used to coat suitable ceramic fibers which can be formed into a porous pad or as a coating on a solid plate of a different ceramic material provided with discrete ports.

It has been discovered that when zircon is exposed to combustion conditions, such as in operation of a radiant burner, an outer layer of zirconia is formed which is highly stable against further degradation during the combustion process and protects the underlying zircon layer from excessive rates of further degradation.

Typically, zircon is considered a relatively low grade refractory material as compared to more expensive single phase ceramics, such as alumina, or zirconia for example. Prior studies have shown that among ceramic materials considered for industrial applications for radiant burners, zirconia exhibits highly desirable properties relative to stability and a longer useful life in harsh industrial combustion environments.

However, in accordance with the present invention, zircon can be effectively used in place of zirconia to provide similar characteristics because of the in situ formation of a zirconia layer over the zircon matrix layer which effectively stabilizes the rate of degradation of the surface and provides a porous radiant burner surface which is very suitable for industrial applications.

The very significant reduction in cost using a zircon layer, in place of the much more expensive ceramic materials suitable for such applications, significantly enhances the ability of the radiant burner technology to penetrate the industrial process heating market in competition with direct impingement type radiant burners. Additionally, the advantages of high thermal output and low nitrous oxide emissions of porous surface radiant burners can be more economically advanced by incorporating the teachings of the present invention.

DETAILED DESCRIPTION

Figure 1:
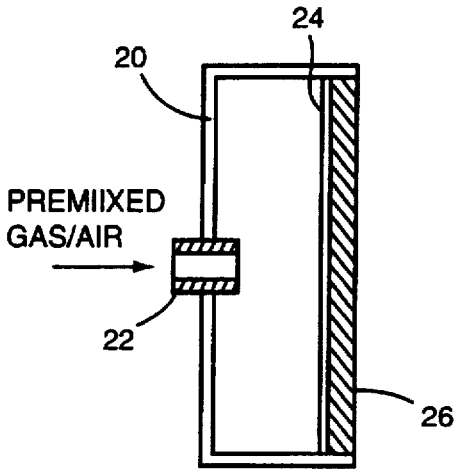
FIG. 1 is a diagrammatic view of a conventional radiant burner construction incorporating the porous burner substrate constructed in accordance with the present invention.

A porous radiant burner assembly constructed in accordance with the present invention is diagrammatically shown in FIG. 1. The structure thereof is generally conventional and well-known to those of ordinary skill in the art except for the porous burner surface constructed in accordance with the present invention. Further, the significant details relating to combustion controls and the like are not shown or described as they are well understood by those skilled in the art and standing alone form no. part of the present invention.

As seen in FIG. 1, the burner assembly includes a housing forming a chamber 20 provided with an inlet 22 for premixed combustion reactants, such as natural gas and air. A support structure 24 for the porous burner surface may be in the form of a screen in the case of a fiber mat or pad, or a sided support frame for a self-supporting structure such as a ported ceramic tile or a reticulated foam structure.

A porous burner substrate 26 is mounted to support structure 24 in a conventional, well-known manner and is communicated to the pre-mixed combustion reactants which enter chamber 20 through inlet 22. In a conventional manner, combustion occurs on the surface of porous burner substrate 26 where the reactants burn with no visible flame and the burner surface becomes heated to incandescence to produce the radiant heat.

The typically recommended materials for ceramic porous radiant burner surfaces useful for industrial applications include alumino-silicates, alumina and zirconia, with zirconia rated in a recent study as the best material to resist long term degradation and provide very suitable useful life. Further, such materials can provide excellent thermal characteristics, high firing capacity and resistance to flashback.

It is known that a major limiting factor in ceramic radiant burner substrates is the long term degradation which occurs on the surface during the combustion process. This involves a continuous removal of the material comprising the burner surface. Also some ceramic materials in particular forms degrade in other ways, such as thermal shock damage or surface densification leading to increased pressure drop. Further some exhibit non-uniform changes in shape or composition during the aging process which tend to lead to unstable and non-uniform firing characteristics.

Zircon, a relatively inexpensive and very abundant ceramic, has previously been used in some low cost, less demanding refractory applications. However, in accordance with the present invention, it has been discovered that it can be used for porous radiant burner applications to provide satisfactory performance and extended useful life in a very cost effective manner compared to using the much more expensive materials, such as zirconia. While zircon tends to initially degrade relatively quickly, I have found that upon exposure to a combustion environment, this process of degradation results in an adherent porous layer of zirconia forming over the zircon matrix which strongly resists further degradation and provides a very suitable burner surface structure. This in situ formation of a zirconia layer over the base zircon matrix provides a very inexpensive method of making a suitable porous radiant burner substrate having a surface which resists degradation and will withstand the rigors of operational use to extend the useful life of the burner.

Since the cost of zircon is merely a small fraction of the pure zirconia cost, improved porous surface burners can be fabricated which retain the required operational advantages with a minimal capital cost of raw material compared to prior methods and means.

Figure 2:
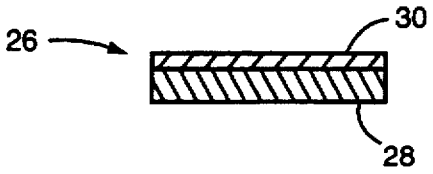
FIG. 2 is a diagrammatic view representing a layer of zircon having a layer of zirconia formed in situ overlying the zircon layer.

The most optimal form of the radiant burner surface using zircon has yet to be established, however a surface comprising conventional forms such as porous foam or ported tile could be employed using zircon as the base material. As seen in FIG. 2, the base layer of zircon 28 has a layer of zirconia formed in situ overlying the zircon layer. Further, it is expected that the combination of a coating layer of zircon having a zirconia layer formed in overlying relationship in situ could also be employed as a protective layer over an alumino-silicate or another suitable ceramic material layer to enable the formation of a relatively inexpensive, but satisfactory burner surface for industrial applications.

For example, using conventional methods, wellknown to those skilled in the art, a slurry of alumino-silicate fibers or other suitable material, could be subjected to a vacuum forming process to form a suitable porous support base. Then a colloidal zircon solution would be drawn through the base to form a zircon coating over the alumino-silicate fibers. Alternately, the colloidal zircon solution may be sprayed upon the fiber support base to apply a suitable coating of zircon over the fibers.

Figure 3:
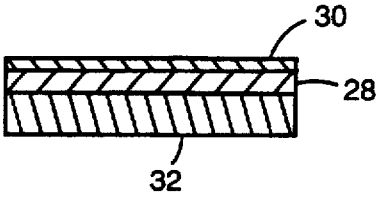
FIG. 3 is a diagrammatic view of another embodiment of the present invention representing a layer of a ceramic substrate having a coating layer of zircon and an overlying layer of zirconia formed in situ on the zircon layer.

To form a ported tile configuration, a base of alumino-silicate powders could be conventionally dry-pressed to form the tile structure. A relatively thin layer of zircon powder could be placed in the die such that an adherent layer of zircon would be formed on one or both opposing outer surfaces of the alumino-silicate base. This form of a suitable burner surface is illustrated diagrammatically in FIG. 3 wherein the alumino-silicate base 32 includes a coating layer 28 of zircon and an overlying layer of zirconia 30 formed in situ upon exposure to suitable combustion conditions such as typically encountered during operation of the porous burner.

It may also be possible to admix the alumino-silicate powder and zircon powder in appropriate proportions which mixture is dry-pressed to form a ported tile having improved properties due to the zircon added to the mixture. An alternative method would be applying a colloidal zircon solution by dipping or spray coating to a formed alumino-silicate tile base support such that the zircon layer forms a protective coating over the supporting tile surface.

In making a radiant burner in a reticulated form configuration, zircon could be introduced as part of the infiltrating solution in the conventional processing of such a burner configuration. Alternatively, zircon could be introduced as part of a protective or emissive overlayer on the surface of a reticulated ceramic foam composition or as a intermediate coating layer disposed between the underlying reticulated foam substrate and any protective or emissive layers which may be conventional in a reticulated ceramic foam composition.

Experiments conducted using a slurry comprising zircon powder mixed with suitable organic liquids, as described in detail in the examples provided later herein, were used to conventionally tape cast small blocks or coupons of zircon. These coupons were subjected to high temperature (1300 degrees C.) in a $H_2/H_2O$ atmosphere for 18 to 24 hours. The weight loss during this period was checked at predetermined intervals and data developed from X-ray diffraction was used to provide information on compositional changes.

These tests showed that significant weight loss initially occurred in the zircon coupons which is attributed to the vaporization loss of $SiO_2$. However, this weight loss stabilized beyond the 20 to 24 hour period. X-ray diffraction data of the coupons indicates that an essentially continuous layer of zirconia was formed over the surface of the original zircon substrate. This zirconia layer appears to account for the apparent cessation of weight loss indicating that the rate of further degradation is very significantly lowered to a level which satisfactorily extends the useful life of a radiant burner surface made of zircon.

Comparative tests run on coupons comprising alumino-silicate appear to continue to lose weight throughout the thermal exposure as expected by prior studies which showed alumina coating compositions to continue to degrade and weaken in combustion environments to the point of failure of the radiant burner structural surface at an unacceptable rate.

Prior work has also shown the zirconia substrates resist degradation in combustion environments and provide significantly longer useful life than alumino-silicate compositions. However, zirconia is relatively expensive. The present invention provides a zirconia layer formed in situ in the combustion environment over the surface of a zircon substrate or a coating of zircon applied over another suitable ceramic substrate support at a very small fraction of the material cost compared to using zirconia as the starting material. This represents a significant finding which provides means to advantageously reduce cost, yet improve rediant burner life which has eluded those skilled in the art.

I claim:

1. A porous surface radiant burner assembly, comprising, in combination;

a) a support structure;

b) a chamber provided with an inlet for communication to a source of pre-mixed combustion reactants and an outlet communicating with said support structure;

c) a porous surface burner substrate mounted to said support structure in communication with said pre-mixed combustion reactants, said substrate including a surface provided with a porous layer of zircon having an overlying layer of zirconia formed in situ upon exposure to operating conditions of said radiant burner.

2. The radiant burner assembly defined in claim 1 wherein said substrate comprises a mat of randomly oriently ceramic fibers carrying a coating layer of zircon which includes an outer layer of zirconia formed in situ upon exposure to operating conditions of said radiant burner.

3. The radiant burner assembly defined in claim 1 wherein said substrate comprises a reticulated porous zircon foam.

4. The radiant burner assembly defined in claim 1 wherein said substrate comprises a solid zircon plate provided with a plurality of discrete ports.

5. The radiant burner assembly defined in claim 1 wherein said substrate comprises a reticulated ceramic foam material different than zircon having a coating layer of zircon and an overlying layer of zirconia formed in situ during operation of said radiant burner.

6. The radiant burner assembly defined in claim 1 wherein said substrate comprises a solid plate of a ceramic material different than zircon provided with a plurality of discrete ports and a coating layer of zircon on said plate having an overlying layer of zirconia formed in situ during operation of said radiant burner.

7. A method of fabricating a substrate for use as a porous radiant burner surface, comprising the steps of: forming a porous burner surface comprising a surface layer of zircon and exposing said zircon layer to combustion conditions sufficient to cause the in situ formation of an adherent porous layer of zirconia overlying a zircon layer.

8. A method of fabricating a substrate for use as a porous radiant burner surface comprising the steps of: forming a porous layer of a ceramic material; coating said ceramic layer with a layer of zircon; and exposing said ceramic layer carrying said coating layer of zircon to combustion conditions sufficient to cause the in situ formation of an adherent porous layer of zirconia over the underlying layer of zircon.

* * * * *